US006682580B2

(12) United States Patent
Findeisen et al.

(10) Patent No.: US 6,682,580 B2
(45) Date of Patent: Jan. 27, 2004

(54) MATRIX POWDER FOR THE PRODUCTION OF BODIES OR COMPONENTS FOR WEAR-RESISTANT APPLICATIONS AND A COMPONENT PRODUCED THEREFROM

(75) Inventors: Eberhard G. Findeisen, Eisenach (DE); Vivek Ranjan Banerjee, Moorgrund-Gumpelstadt (DE); Richard F. Moll, Eisenach (DE); Siegmund Kremmer, Wernshausen (DE)

(73) Assignee: WOKA Schweisstechnik GmbH (DE)

( * ) Notice: Subject to any disclaimer, the term of this patent is extended or adjusted under 35 U.S.C. 154(b) by 0 days.

(21) Appl. No.: 10/122,175

(22) Filed: Apr. 16, 2002

(65) Prior Publication Data

US 2003/0037639 A1 Feb. 27, 2003

(30) Foreign Application Priority Data

Jun. 28, 2001 (DE) ..... 101 30 860
Jul. 6, 2001 (DE) ..... 101 32 283
Nov. 21, 2001 (DE) ..... 101 57 079

(51) Int. Cl.[7] ..... C22C 29/02
(52) U.S. Cl. ..... 75/236; 75/239; 75/240; 75/242; 428/545
(58) Field of Search ..... 75/240, 236, 239, 75/242; 428/545

(56) References Cited

U.S. PATENT DOCUMENTS 4,356,037 A * 10/1982 Novak ..... 428/325
4,944,774 A 7/1990 Keshaven et al.
5,089,182 A 2/1992 Findeisen et al.
5,492,186 A * 2/1996 Overstreet et al. ..... 175/374
5,589,268 A 12/1996 Kelley et al.
5,663,512 A 9/1997 Schader et al.
5,733,649 A 3/1998 Kelley et al.
5,733,664 A 3/1998 Kelley et al.
5,791,422 A 8/1998 Liang et al.
5,880,382 A * 3/1999 Fang et al. ..... 75/236
5,918,102 A 6/1999 Friederichs
5,921,330 A * 7/1999 Sue et al. ..... 175/374
5,944,127 A * 8/1999 Liang et al. ..... 175/374
RE37,127 E 4/2001 Schader et al.
6,360,832 B1 * 3/2002 Overstreet et al. ..... 175/374
6,454,028 B1 9/2002 Evans

FOREIGN PATENT DOCUMENTS

FR 2667804 10/1990

* cited by examiner

*Primary Examiner*—Ngoclan Mai
(74) *Attorney, Agent, or Firm*—Banner & Witcoff, Ltd.

(57) ABSTRACT

A matrix powder for the production of components for wear-resistant applications by forming the matrix powder, along with an infiltrant, into a matrix, and and a wear-resistant component produced therefrom are presented. In order to improve mechanical properties, in particular resistance to erosion, it is proposed for at least some of the hard material to be in the form of spheroidal hard-material particles with a particle size of less than 500 $\mu$m.

18 Claims, No Drawings

MATRIX POWDER FOR THE PRODUCTION OF BODIES OR COMPONENTS FOR WEAR-RESISTANT APPLICATIONS AND A COMPONENT PRODUCED THEREFROM

BACKGROUND OF THE INVENTION

The invention relates to matrix powders for the production of bodies or components for wear-resistant applications, and to a component produced therefrom.

Known matrix powders are processed using an infiltrant to form wear-resistant components which are used predominantly in the oil exploration sector.

A particular field of use for matrix powders is the production of diamond drill bits for oil drilling. As far as the applicants are aware, the relevant prior art is given in U.S. Pat. No. 5,733,664, U.S. Pat. No. 5,733,649 and U.S. Pat. No. 5,589,268.

In all three of the patents mentioned above, sintered crushed cermets, predominantly based on tungsten carbide with cobalt as binder metal, and monocrystalline tungsten carbide (WC) and cast tungsten carbide, a eutectic mixture of WC and $W_2C$, are mentioned with regard to the hard materials for the compositions of the matrix powder.

In U.S. Pat. No. 5,733,664, in addition to sintered crushed cermets based on WC with cobalt as binder metal, sintered crushed cermets based on WC with nickel as metallic binder are also described.

According to all three patents, the particle sizes of the hard materials used are of the order of magnitude of 45 to 180 $\mu$m or of the order of magnitude of 400 to 120 mesh; mixtures of various particle size fractions are mentioned, but overall these always lie in the range from 45 to 180 $\mu$m or from 400 to 120 mesh. The matrix powders which are mentioned in the patent may contain either just one hard material component or mixtures of various hard materials.

U.S. Pat. No. 5,733,664 and U.S. Pat. No. 5,589,268 encompass not only the actual matrix powders but also the infiltration materials. These are alloys of composition Cu—Ni—Zn and Cu—Mn—Ni—Zn, in some cases also with additions of Mn, B and Si.

In a different technical field FR 2 667 804 describes a process for producing plates with a wear-resistant surface, in which the wear-resistant surface is formed by a composite material based on tungsten carbide powder bound in a soldering alloy. The tungsten carbide powder used in this case comprises cast tungsten carbide (WC-$W_2C$), most of the particles being spherical in shape and having a diameter of more than 0.5 mm.

The various particle size ranges, which are matched to one another, of the individual hard materials used for the production of diamond drill bits in accordance with U.S. Pat. No. 5,733,664, U.S. Pat. No. 5,733,649 and U.S. Pat. No. 5,589,268 should provide not only a good resistance to abrasion but also a good resistance to erosion to the infiltration component subsequently produced therefrom. In practice, however, it has been found that the hard materials used, if the matrix surrounding them is washed out through erosion, offer a good point of attack for the wear-inducing material.

Furthermore, although these hard-material particles do have a very high hardness, they are also, by their very nature, very brittle. The associated reduced impact strength in turn makes it easier for fractures to form, in particular from corners and edges of block particles of these materials.

Moreover, in addition to the notch effect for the surrounding matrix caused by the edged morphology of such hard materials, a further notch effect occurs when the hard materials fracture, which can cause additional incipient cracking in the surrounding matrix material. This incipient cracking or these initial cracks then have an adverse effect on the fatigue strength of the infiltrated component.

It is an object of the invention to provide a matrix powder and a wear-resistant component produced therefrom in which, compared to known matrix powders or components, the mechanical properties in use, in particular the resistance to erosion, are improved.

SUMMARY OF THE INVENTION

The invention is based on the discovery that the particle shapes of the hard material particles used have a disadvantageous effect with regard to the wear resistance of the infiltrated components with the abovementioned compositions for matrix powders. Their block and edged morphology means that they offer a good point of attack for the wear-inducing material.

The drawbacks in the wear resistance of previous infiltration components can be considerably alleviated by the use of spheroidal hard materials, since spheroidal particles, especially if they are in the same particle size range as the abrasive or erosive material, offer a substantially smaller surface for this material to attack.

Furthermore, spheroidal hard materials do not give rise to any notch effect into the surrounding matrix, with the result that the fatigue strength of infiltrated components is improved considerably. If spheroidal hard materials are made in the form of a dense-sintered composite, comprising metal carbides and a metallic binder, it is also possible to improve the impact strength of such hard-material particles compared to pure carbides, so that the above mentioned additional notch effect when the particles break can be reduced, which in turn results in an improved fatigue strength of the infiltration bodies.

Therefore, the invention relates to matrix powders which contain spheroidal hard materials, preferably in particle sizes of the same order of magnitude as the attacking wear-inducing particles. Components produced from these matrix powders exhibit improved mechanical properties.

DETAILED DESCRIPTION OF THE INVENTION

The hard material particles used may firstly be spheroidal carbides, as described in U.S. Pat. No. 5,089,182 in the name of the present applicant. It is also possible to use dense-sintered spheroidal powders, preferably with a closed porosity or pore-free. Alternatively, it is also possible for the spheroidal hard materials to be in the form of sintered pellets, as are produced in accordance with the prior art by various manufacturers, such as Kennametal Inc., Latrobe, Reed Tool Company, Houston and also the assignee of the present invention.

A matrix powder according to the invention for the production of components for wear-resistant purposes which contain hard material in powder form is distinguished by the fact that at least some of the hard material is in the form of spheroidal hard-material particles with a particle size of less than 500 $\mu$m. The particle size of the spheroidal hard materials is particularly preferably between 20 and 250 $\mu$m.

It is possible for the matrix powder to consist exclusively of the spheroidal hard material. However, it is also possible to add further constituents to the matrix powder. The above mentioned advantageous properties of the matrix powder and the infiltration components manufactured therefrom can be observed even if only at least 5% by weight of the matrix powder is formed by spheroidal hard-material particles. However, it is preferable for at least 30% by weight of the matrix powder to be formed from spheroidal hard-material particles, and even more than 50% by weight is particularly preferred.

To allow infiltration of the matrix powder during production of a component which is to be protected against wear, it may be of assistance for the matrix powder to contain a further component which functions as a spacer, so that, in particular with small particle sizes, the spheroidal hard-material particles are not packed too closely together. In such cases, the matrix powder may contain block hard material, e.g. in the form of crushed carbides, or a metal powder. When using block carbides, the particle size of these carbides is preferably between 3 and 250 μm. The particle size of a metallic powder used is preferably between 20 and 150 μm. Examples of the metallic powders and block hard materials which can be used and of the spheroidal hard materials are given in the exemplary embodiments.

The spheroidal sintered material which is suitable for the spheroidal hard material is a new development of the assignee which is described in DE 101 30 860.4 which is incorporated herein by reference. Below is given an example for a process for producing the sintered material:

EXAMPLE OF A PROCESS FOR PRODUCING SPHEROIDAL SINTERED HARD MATERIAL PARTICLES

The powder starting material with a porous internal structure used is the commercially available product WOKA 9406 Co sold by the assignee of the present invention, which comprises 94% by weight of WC and 6% by weight of Co and which is an agglomerated sintered material. The selected powder starting material, which has a particle size range from 5 to 200 μm, it being possible for in each case 10% by weight to have a larger or smaller particle size than the upper particle size limit or the lower particle size limit, undergoes preliminary fractionation by screening. The preliminary fraction is in the particle size range from −75 to 125 μm.

The agglomerated particles of the selected powder starting material are introduced into graphite boats, which are placed in a sinter HIP furnace. There then follows the sintering process step, at a temperature of approximately 1430° C. and under an argon gas pressure of 40 bar, the process time being 20 minutes.

During the sintering step, the volume of the particles of the selected powder starting material is reduced by approximately 20%, so that dense-sintered agglomerated particles are present.

The sintered material is cooled in the sinter HIP furnace. After the process has been carried out, there is a small proportion of material bridges between the individual particles of the sintered material. Therefore, the sintered product is milled in order to break open the material bridges.

The milling step is followed by final screening to produce the finished sintered material, which has a particle size range of from 63 to 106 μm. The final screening is only required if a different particle size distribution from that produced after the milling step is desired.

The finished sintered material has a homogeneous distribution of the tungsten carbide and of the cobalt, has a spheroidal external shape, on account of the application of the gas pressure, and is substantially free of pores.

The above example is one embodiment of a process for producing sintered material from spheroidal sintered particles of predetermined mean particle size in the range between 20 and 180 μm which have a predominantly closed porosity or are pore-free, comprising the following steps:

a) Providing a substantially spheroidal powder starting material with a partially porous inner structure, which has a mean grain size which is greater than the predetermined mean particle size of the spheroidal sintered particles substantially by the size of the pore fraction and which contains 80–97% by weight of sinterable hard material with a particle size of between 0.6 and 5 μm and 3 to 20% by weight of metallic binder with a particle size of 0.6 to 5 μm, b) Introducing the powder starting material into a furnace, c) Sintering the powder starting material, initially by exposing the powder starting material to heat at a temperature at which the material of the metallic binder adopts a pasty state, and then by applying a gas pressure at which the particle size of the individual particles of the powder starting material is reduced as a result of the reduction in the pore content of the starting material to the predetermined mean particle size distribution of the spheroidal sintered particles, and d) Cooling the spheroidal sintered particles and removing the spheroidal sintered particles from the furnace.

If necessary, material bridges which form between accumulations of sintered particle assemblies can be broken open without destroying the individual spheroidal sintered particles. This takes place in a milling device.

Preferred Embodiments of Matrix Powders According to the Invention

A number of exemplary embodiments of matrix powders are presented below. The powders are mixed in the compositions indicated. The particle size distributions indicated are achieved by screening. In this case, the values given in the tables are to be understood in such a way that, for example, after the indication "+180 μm" is given the proportion of particles which are larger than 180 μm, and in the following line, after the indication "+150 μm" is given the proportion of particles which are larger than 150 μm but smaller than 180 μm.

In general, a particle size distribution in which between 30 and 60% by weight of the hard materials lie in the particle size range from 106 to 250 μm and 40 to 70% by weight lie in the particle size range of −106 μm is preferred.

Example 1

The matrix powder is made up of 100% of spheroidal hard materials. The spheroidal hard materials comprise spheroidal carbides, preferably spheroidal $WC-W_2C$, or dense-sintered powders with a closed porosity or pore-free or sintered pellets, in each case preferably with a composition of 94% by weight of WC and 6% by weight of Co, with the following particle size distribution:

| | |
|---|---|
| +180 μm | 2% max. |
| +150 μm | 2–5% |
| +106 μm | 15–20% |
| +75 μm | 16–24% |
| +45 μm | 22–26% |
| −45 μm | 30–38% |

Example 2

The matrix powder is made up of 80–99% of spheroidal hard materials, either spheroidal carbides, preferably spheroidal WC-$W_2C$, or dense-sintered powder with a closed porosity, or pore-free or sintered pellets, in each case preferably having a composition of 94% by weight of WC and 6% by weight of Co, and of 1–20% by weight of metallic powder, preferably Ni in the particle size range from 20 to 160 μm. The spheroidal carbides have the following particle size distributions:

| | | or | or |
|---|---|---|---|
| +212 μm | 4% max | 2% max | 1% max |
| +150 μm | 35–47% | 25–38% | 8–16% |
| +106 μm | 15–27% | 15–25% | 12–22% |
| +75 μm | 8–15% | 10–15% | 12–22% |
| +38 μm | 15–28% | 18–28% | 25–35% |
| −38 μm | 6% max | 20% max | 20–32% |

Example 3

The matrix powder is made up of 100% of a mixture of spheroidal hard materials. The mixture comprises spheroidal carbides, preferably WC-$W_2C$, and/or spheroidal dense-sintered powders with a closed porosity or pore-free and/or sintered pellets, both preferably having a composition of 94% by weight of WC and 6% by weight of Co. The particle sizes of this mixture of spheroidal hard materials are distributed as follows:

| | |
|---|---|
| +180 μm | 2% max. |
| +150 μm | 2–5% |
| +106 μm | 15–20% |
| +75 μm | 16–24% |
| +45 μm | 22–26% |
| −45 μm | 30–38% |

Example 4

The matrix powder is made up of 80–99% of a mixture of spheroidal hard materials and of 1–20% of a metallic powder, preferably Ni in the particle size range 20 μm to 160 μm. The mixture of spheroidal hard materials comprises spheroidal carbides, preferably WC-$W_2C$, and/or spheroidal dense-sintered powders with a closed porosity or pore-free and/or sintered pellets, both preferably having a composition of 94% by weight of WC and 6% by weight of Co. The mixture of spheroidal hard materials has the following particle size distributions:

| | | or | or |
|---|---|---|---|
| +212 μm | 4% max | 2% max | 1% max |
| +150 μm | 35–47% | 25–38% | 8–16% |
| +106 μm | 15–27% | 15–25% | 12–22% |
| +75 μm | 8–15% | 10–15% | 12–22% |
| −38 μm | 15–28% | 18–28% | 25–35% |
| −38 μm | 6% max | 20% max | 20–32% |

Example 5

The matrix powder is made up of 5–99% of spheroidal hard materials, preferably spheroidal WC-$W_2C$, or dense-sintered powder with a closed porosity or pore-free or sintered pellets, both preferably with a composition of 94% by weight of WC and 6% by weight of Co, remainder block hard materials based on carbides, preferably WC-$W_2C$, and/or sintered crushed cermets, preferably with a composition of 94% by weight of WC and 6% by weight of Co. The hard materials have the following particle size distribution:

| | |
|---|---|
| +180 μm | 2% max. |
| +150 μm | 2–5% |
| +106 μm | 15–20% |
| +75 μm | 16–24% |
| +45 μm | 22–26% |
| −45 μm | 30–38% |

Example 6

The matrix powder is made up of 5–99% of spheroidal hard materials, preferably spheroidal WC-$W_2C$, or dense-sintered powder with a closed porosity or pore-free or sintered pellets, both preferably with a composition of 94% by weight of WC and 6% by weight of Co, remainder block hard materials based on carbides, preferably WC-$W_2C$, and/or sintered crushed cermets, preferably with a composition of 94% by weight of WC and 6% by weight of Co, and a metallic powder in a proportion of 1–20% by weight, preferably Ni in the particle size range −106+20 μm. The hard materials have the following particle size distribution:

| | | or | or |
|---|---|---|---|
| +212 μm | 4% max | 2% max | 1% max |
| +150 μm | 35–47% | 25–38% | 8–16% |
| +106 μm | 15–27% | 15–25% | 12–22% |
| +75 μm | 8–15% | 10–15% | 12–22% |
| +38 μm | 15–28% | 18–28% | 25–35% |
| −38 μm | 6% max | 20% max | 20–32% |

Example 7

The matrix powder is made up of 5–99% by weight of a mixture of spheroidal hard materials, remainder block hard materials. The mixture of the spheroidal hard materials comprises spheroidal carbides, preferably WC-$W_2C$, and/or spheroidal dense-sintered powders with a closed porosity or pore-free and/or sintered pellets, both preferably with a composition of 94% by weight of WC and 6% by weight of Co. The block hard materials comprise block-shaped carbides preferably comprising WC-$W_2C$, and/or sintered crushed cermets, preferably with a composition of 94% by weight of WC and 6% by weight of Co. The particle size distribution of this mixture is:

| | |
|---|---|
| +180 μm | 2% max. |
| +150 μm | 2–5% |
| +106 μm | 15–20% |
| +75 μm | 16–24% |
| +45 μm | 22–26% |
| −45 μm | 30–38% |

Example 8

The matrix powder is made up of 1–99% by weight of a mixture of spheroidal hard materials, remainder block hard materials and a metallic powder in a proportion of 1–20% by weight, preferably Ni in the particle size range −106+20 μm.

The mixture of spheroidal hard materials comprises spheroidal carbides, preferably WC-$W_2C$, and/or spheroidal dense-sintered powders with a closed porosity or pore-free and/or sintered pellets, both preferably with a composition of 94% by weight of WC and 6% by weight of Co. The block hard materials comprise block carbides preferably comprising WC-$W_2C$, and/or sintered crushed cermets, preferably with a composition of 94% by weight of WC and 6% by weight of Co. The hard material mixture has the following particle size distribution:

| | | or | or |
|---|---|---|---|
| +212 μm | 4% max | 2% max | 1% max |
| +150 μm | 35–47% | 25–38% | 8–16% |
| +106 μm | 15–27% | 15–25% | 12–22% |
| +75 μm | 8–15% | 10–15% | 12–22% |
| +38 μm | 15–28% | 18–28% | 25–35% |
| −38 μm | 6% max | 20% max | 20–32% |

Production of a Wear-resistant Infiltration Component

A wear-resistant component is produced from the matrix powder in a manner which is known per se to a person skilled in the art by introducing the matrix powder into a mould, where it is shaken down by being vibrated. Then, a suitable infiltrant is added and the mould is heated in the furnace, the infiltrant melting and infiltrating the matrix powder. After cooling, the result is a wear-resistant component, for example a drill bit. This production process is also described, for example, in U.S. Pat. No. 5,733,664. Here, also, examples of possible infiltration materials are given. The contents of this disclosure is included here by reference.

The depth from the surface to which the infiltrant penetrates is referred to as the infiltration depth. This depth is preferably more than 30 mm.

The wear-resistant component formed in this way, on account of the spheroidal hard material particles used therein, has a high resistance to abrasion and erosion and a high fatigue strength in use.

What is claimed is:

1. A wear-resistant component comprising a matrix powder and a metal-containing infiltrant, said matrix powder and said metal-containing infiltrant forming a matrix;

said matrix powder comprising hard material particles, said hard-material particles having a particle size of less than 500 μm, said hard material particles comprising hard material particles of spheroidal shape, and crushed carbide particles, said crushed carbide particles having particle sizes of 3 to 250 μm; and wherein the infiltration depth of said metal containing infiltrant is greater than 30 mm.

2. The wear-resistant component of claim 1, said matrix powder further containing at least 30% by weight of spheroidal hard-material particles.

3. The wear-resistant component of claim 1, where said spheroidal hard-material particles have a particle size of between 20 and 250 μm.

4. The wear-resistant component of claim 1, wherein said spheroidal hard material particles are spheroidal carbides of one of the metals selected from the group consisting of: W, Cr, Mo, Nb, V, Ti.

5. The wear-resistant component of claim 1, where said spheroidal hard material particles are dense-sintered powders with a closed porosity or pore-free, dense-sintered powders, said dense-sintered powders being based on carbides of one of the metals selected from the group containing W, Cr, Mo, Nb, V, Ti or mixtures thereof, with a metallic binder based on one of the materials selected from the group containing Co, Cr, Ni, Fe or mixtures or alloys thereof.

6. The wear-resistant component of claim 1, where said spheroidal hard material particles are sintered pellets, said sintered pellets being based on carbides of one of the metals selected from the group containing W, Cr, Mo, Nb, V, Ti or mixtures thereof, the matrix powder further containing a metallic binder based on one of the materials selected from the group consisting of: Co, Cr, Ni, Fe or mixtures or alloys thereof.

7. The wear-resistant component of claim 1, said spheroidal hard material particles containing between 80 and 97% by weight of carbides and 3 to 20% by weight of metallic binder.

8. A wear-resistant component comprising a matrix powder and a metal-containing infiltrant, said matrix powder and metal-containing infiltrant forming a matrix; said matrix powder comprising hard material particles having a particle size of less than 500 μm, wherein at least a plurality of said hard material particles have a spheroidal shape and 30 to 60% by weight of said spheroidal hard-material particles have a particle-size in the range of 106 μm to 250 μm, and the remaining of said spheroidal hard-material particles have a particle size of less than 106 μm; and wherein the infiltration depth of said metal-containing infiltrant is greater than 30 mm.

9. A wear-resistant component comprising a matrix powder and a metal-containing infiltrant, said matrix powder and metal-containing infiltrant forming a matrix; said matrix powder containing at least 5% by weight of spheroidal hard material particles, where 30 to 60% by weight of said spheroidal hard-material particles have a particle size in the range of 106 μm to 250 μm, and the remaining of said spheroidal hard-material particles have a particle size of less than 106 μm; and wherein the infiltration depth of said metal-containing infiltrant is greater than 30 mm.

10. The wear resistant component of claim 9, wherein said matrix powder contains crushed carbide particles in a concentration of at least 5% by weight.

11. The wear-resistant component of claim 9, said matrix powder further containing a metallic powder in a concentration of 1 to 12% by weight.

12. The wear-resistant component of claim 11, said metallic powder consisting of a material selected from the group containing Co, Ni, Cr, W, Cu or Fe or a mixture of alloy of these substances.

13. The wear-resistant component of claim 11, in which the particle sizes of the metallic powder are between 20 and 150 μm.

14. The wear-resistant component of claim 1 in which said crushed carbide particles are based on carbides of one of the metals selected from the group consisting of: W, Cr, Mo, Nb, V, Ti.

15. The wear resistant component of claim 1, in which said crushed carbide particles are sintered crushed cermets based on carbides of one of the metals selected from the group consisting of: W, Cr, Mo, Nb, V, Ti, the matrix powder further containing a metallic binder based on Co, Cr, Ni, Fe or mixtures or alloys thereof.

16. The wear-resistant component of claim 1, wherein said crushed carbide particles are in a concentration of at least 5% by weight.

17. The wear-resistant component of claim 1, wherein said matrix powder further comprises a metallic powder in a concentration of 1 to 12% by weight.

18. The wear-resistant component of claim 1, in which said crushed carbide particles are sintered crushed cermets based on carbides of one of the metals selected from the group consisting of: W, Cr, Mo, Nb, V, Ti, and further containing a metallic binder based on Co, Cr, Ni, Fe or mixtures or alloys thereof.

* * * * *